United States Patent [19]

Scott

[11] Patent Number: 4,845,845

[45] Date of Patent: Jul. 11, 1989

[54] PLASTIC SHAVING DEVICE

[76] Inventor: Avery Scott, 306 W. Hopkins, Pontiac, Mich. 48058

[21] Appl. No.: 248,268

[22] Filed: Sep. 21, 1988

Related U.S. Application Data

[63] Continuation of Ser. No. 76,742, Jul. 23, 1987, abandoned.

[51] Int. Cl.[4] ..... B26B 21/00

[52] U.S. Cl. ..... 30/32; 30/172

[58] Field of Search ..... 30/30, 32, 34.2, 26, 30/41, 47, 86, 169, 172; 15/245; 132/289

[56] References Cited

U.S. PATENT DOCUMENTS

| | | | |
|---|---|---|---|
| D. 282,878 | 3/1986 | Skidmore | D 28/46 |
| D. 174,037 | 2/1955 | Glaberson | D 22/3 |
| D. 193,299 | 7/1962 | Dreyfuss | D 22/3 |
| D. 248,878 | 8/1978 | Halm | D 28/46 |
| D. 269,466 | 6/1983 | Gruber | D 28/46 |
| 2,598,104 | 5/1952 | Bianchi | 30/53 |
| 2,699,602 | 1/1955 | Finley | 30/47 |
| 3,052,023 | 9/1962 | Meohas | 30/32 X |
| 3,078,569 | 2/1963 | Sidney et al. | 30/32 |
| 4,285,125 | 8/1981 | Chen et al. | 30/53 |
| 4,473,944 | 10/1984 | Carroll | 30/41 |

*Primary Examiner*—Frank T. Yost
*Assistant Examiner*—Michael D. Folkerts
*Attorney, Agent, or Firm*—Basile and Hanlon

[57] ABSTRACT

A plastic shaving device for use with a hair removal product. The device comprises a head having a first scraper formed on an edge thereof and a handle attached to the head, the handle having a second scraper formed on an edge thereof. The first and second scrapers are disposed at right angles to each other, and the handle extends from the head to form an obtuse angle therewith. The first scraper is adjacent the obtuse angle and the second scraper is opposite the obtuse angle.

5 Claims, 1 Drawing Sheet

PLASTIC SHAVING DEVICE

BACKGROUND OF THE INVENTION

1. Field of the Invention

This invention relates to a hair removal device and more particularly to a hair removal device for use with a hair removal product.

2. Prior Art

Since time immemorial, different methods have been used to remove unwanted hair from various parts of the human body. These methods have included scraping or shaving the hair off with a sharp bladed instrument, plucking the hair either with an instrument such as tweezers or with the assistance of a wax dipilatory, and the use of various chemicals either to dissolve the hair shaft completely or so attenuate it that it may easily be removed by, for example, wiping.

The use of chemical depilatories to help dissolve hair shafts has long been known in the prior art. These chemical depilatories typically take the form of creams, such as, for example, Nair®, or powders, such as, for example, Magic Shaving Powder®, both commercially available. Chemical depilatories of these types are typically used by those persons who wish to remove hair that is relatively sparse and fine in its growth pattern. For example, chemical depilatory powders are commonly used by males of non-European descent to remove unwanted facial hair. When used in this manner, the use of the chemical depilatory powder is a substitute for actual shaving of the beard and/or mustache.

Although widely in use, these chemical depilatory powders have sometimes produced less than satisfactory results. After the face has been wetted, the powder wetted and applied thereto and a sufficient amount of time allowed to elapse to permit the chemical to act on the hair, it is necessary to remove the wetted powder and hairs from the skin surface. In order to do this, it has heretofore been the practice either to simply wipe off the chemical and hair residue, or to use a regular blade razor for removal. In the former case, frequently the results are unsatisfactory because some of the hair shafts are incompletely dissolved and hair remains on the face. In the later case, the possibility of cutting or abrading the face with the razor blade exists, and often such a cut or abrasion, in combination with the often harsh chemicals used in the depilatory, can result in significant damage to the face.

What is needed is a safe, effective way of removing chemical and hair residues resulting from the application of chemical depilatories for hair removal which does not leave unwanted hair remaining on the face and does not cause physical damage thereto.

What is also needed is a device which effectuates safe, efficient hair removal for use with a chemical depilatory and which is versatile enough to be used by both those accustomed to a straight edged razor and those accustomed to a safety razor.

SUMMARY OF THE INVENTION

Disclosed herein is a plastic shaving device for use with a hair removal product such as a chemical depilatory. The device comprises a head with a first scraper formed on an edge thereof and a handle attached to the head, the head having a second scraper formed on an edge thereof.

In a preferred embodiment, the handle extends angularly from the head and forms an obtuse angle therewith. The first scraper is formed on the edge of the head adjacent the obtuse angle and the second scraper is formed on the edge of the handle opposite the obtuse angle.

In another preferred embodiment, the device comprises a planar head member with a first scraper formed on an edge thereof. A planar handle member is attahced to a face of said head member and extends transversely and angularly therefrom. The angle formed between the planar head member and the planar handle member is an obtuse angle, and the handle extends toward the first scraper. The handle has a second scraper formed on an edge thereof opposite the obtuse angle. The first scraper is adjacent the obtuse angle.

Preferably, the head and handle of the plastic shaving device of the instant invention will be formed as an integral unit by a process such as, for example, injection molding. It is contemplated that the first and second scraper edges will each be formed by a narrowed, angled portion integral with the rest of the device. Hence, the scraper edges so formed, while not being of an acuity sharp enough to actually sever the hair shafts, will be sufficient to cause removal of any dissolved or weakened hair shafts.

The device of the instant invention may be used in either of two different ways. After the chemical depilatory has been applied to, for example, the face and suitably moistened, the user may grasp the handle of the herein device and use the first scraper edge formed on the head attached thereto to scrap the hair and chemical depilatory residue from the face. When used in this manner, the herein device simulates the method of use of a double edged or safety razor. Because the handle extends angularly from the head, the first scraper will contact the face at a suitable angle for effective hair removal when the handle is held by a user.

Alternatively, for those who prefer to use the device in the manner of a straight razor, the device may be held by the handle at a portion thereof adjacent the head and the second scraper may be used to remove the hair and chemical depilatory. Again, because of the angular shaping of the device, the second scraper edge will be disposed at a correct angle relative to the skin surface when correctly grasped by the user.

Due to the fact that both the first and second scrapers are not sharp edges but, rather, are somewhat blunt, no danger will ensue to the user from grasping any part of the handle or head of the instant device. Because of the bluntness of the scrapers, the user will be relieved from concern about accidental cutting or abraiding of the skin surface while the device is being used.

It is contemplated that, due to the inexpensive nature of the plastic material from which it is formed and the ease of manufacture, the herein device can be manufactured very cheaply. The device could even be made to be disposable or should the user care to, it would be suitable for repeated use since the relatively blunt scrapers will not degrade after repeated use.

BRIEF DESCRIPTION OF THE DRAWING

The various features, advantages and other uses of the present invention will become more apparent by referring to the following detailed description and drawing in which.

DETAILED DESCRIPTION OF THE PREFERRED EMBODIMENTS

Figure 2:
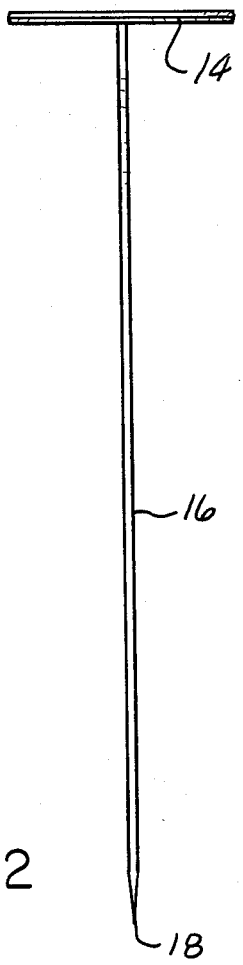
FIG. 2 is a front view of the shaving device shown in FIG. 1.

Throughout the following description and drawing, identical reference numbers are used to refer to the same components shown in multiple figures of the drawing.

Figure 1:
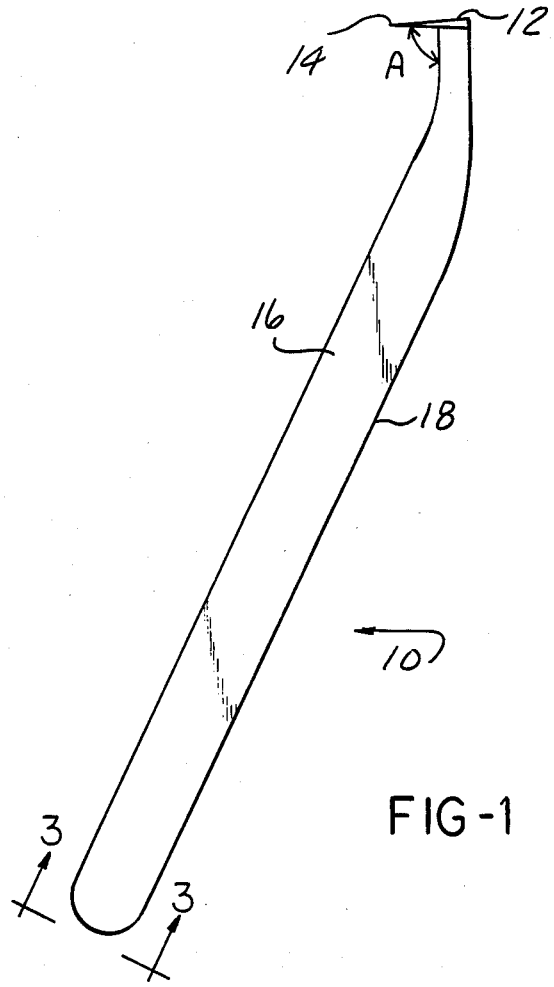
FIG. 1 is a right side view of a shaving device of the present invention.

Referring now to the drawing, and to FIG. 1 in particular, there is illustrated a shaving device 10 comprised of a head 12 and a handle 16 attached thereto. As may be seen by referring to FIGS. 2 and 3, head 12 and handle 16 are planar in shape. Handle 16 is attached to a bottom face 20 of head 12 and extends transversely and angularly therefrom. The angle A formed between handle 16 and head 12 is an obtuse angle.

Formed on an edge of head 12 is first scraper 14. First scraper 14 is formed on the side of head 14 adjacent obtuse angle A. formed on an edge of handle 16 is second scraper 18. Second scraper 18 is formed on the edge of handle 16 opposite obtuse angle A.

Figure 3:
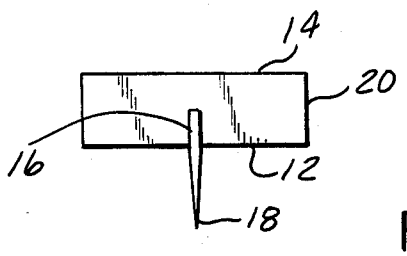
FIG. 3 is a bottom view of the shaving device shown in FIG. 1.

As may be seen by referring in particular to FIGS. 1 and 3, first and second scrapers 14, 18 are formed integrally with head 12 and handle 16, respectively, and each constitute a narrowed down portion which forms a relatively blunt edge.

Because two scrapers 14 and 18 are provided, the plastic shaving device 10 of the instant invention may be used in either one of two ways. First, the user may grasp handle 16 so that first scraper 14 faces forward and use first scraper 14 to remove hair and chemical depilatory from the skin surface. The obtuse angle formed between handle 16 and head 14 will cause first scraper 14 to be positioned at a correct angle relative to the skin surface when handle 16 is grasped by the user.

Alternatively, the user may grasp handle 16 at a portion thereof adjacent head 14 so that second scraper 18 faces forward. When used in this manner, the plastic shaving device 10 simulates the use of a straight edged razor.

Other configurations and arrangements of the elements disclosed herein may occur to one skilled in the art without departing from the spirit of the inventive concept disclosed herein. For example, the exact shape of the handle is not critical. Instead of extending from the head in the somewhat curved manner depicted in FIG. 1, the handle might be formed angularly. Additionally, the device may comprise additional structures such as thickened portions of either the handle or the head or both to lend additional structural support to the device. Likewise, further refinement may be added to the handle to make it more conformable to the human hand. While the invention has been described with reference to certain embodiments and exemplifications thereof, it is not intended to be so limited but solely by the claims appended hereto.

I claim:

1. A plastic shaving device for use with a hair removal product, said device comprising:

a substantially planar rectangular head having first and second generally planar surfaces with a narrowed down, angled portion adjacent a long peripheral edge between said first and second planar surfaces, forming a relatively blunt edged first scraper integrally on the head; and a substantially planar elongated handle attached substantially perpendicular to one of the planar surfaces of said head with a lateral axis of the handle perpendicular to the first scraper, said handle having third and fourth generally planar surfaces with a narrowed down angled portion adjacent a long peripheral edge between said third and fourth planar surfaces, forming a relatively blunt edged second scraper integrally on the handle along substantially an entire length of the edge thereof, wherein the second scraper is generally disposed at a skewed right angle with respect to the first scraper.

2. The plastic shaving device of claim 1 wherein the head is integral with the handle.

3. A plastic shaving device for use with a hair removal product, said device comprising:

a substantially planar rectangular head having a first scraper formed integrally on a long peripheral edge thereof wherein the edge is tapered toward a point to form the first scraper; and a substantially planar elongated handle attached substantially perpendicular to a face of said head, said handle having a lateral axis perpendicular to the long peripheral edge of the head and a second scraper formed integrally along substantially an entire length of a long peripheral edge thereof, wherein the edge is tapered toward a point to form the second scraper, said first and second scrapers being disposed at skewed right angles to each other.

4. A plastic shaving device for use with a hair removal product, said device comprising:

a substantially planar rectangular head member with a first scraper integrally formed on a long peripheral edge thereof, wherein the edge is tapered toward a point to form the first scraper; and a substantially planar elongated handle member attached substantially perpendicularly to a face of said head member, said handle member having a first portion formed integrally with said head member and a second portion extending angularly from said first portion at an obtuse angle, and having a second scraper integrally formed along substantially an entire length of a long peripheral edge of said second portion facing outwardly with the respect to the obtuse angle, wherein the edge is tapered toward a point to form the second scraper, said first and second scrapers disposed at skewed right angles to each other, wherein the first scraper faces inwardly with the respect to the obtuse angle.

5. The plastic shaving device of claim 4, wherein the first portion of the handle member forms an obtuse angle A with respect to the head member.

* * * * *